US006681858B2

(12) United States Patent
Streater

(10) Patent No.: US 6,681,858 B2
(45) Date of Patent: Jan. 27, 2004

(54) PACKER RETRIEVER

(75) Inventor: James R Streater, Humble, TX (US)

(73) Assignee: National-Oilwell, L.P., Houston, TX (US)

( * ) Notice: Subject to any disclaimer, the term of this patent is extended or adjusted under 35 U.S.C. 154(b) by 0 days.

(21) Appl. No.: 10/140,038

(22) Filed: May 6, 2002

(65) Prior Publication Data

US 2003/0205377 A1 Nov. 6, 2003

(51) Int. Cl.[7] ..... E21B 31/12
(52) U.S. Cl. ..... 166/301; 166/178
(58) Field of Search ..... 166/55, 55.7, 55.8, 166/178, 301, 376, 381

(56) References Cited

U.S. PATENT DOCUMENTS 4,696,502 A * 9/1987 Desai ..... 294/86.17
4,898,245 A * 2/1990 Braddick ..... 166/387
5,085,479 A * 2/1992 Taylor ..... 294/86.17
5,123,489 A * 6/1992 Davis et al. ..... 166/377

OTHER PUBLICATIONS

*Instruction Manual, ITCO Type Bowen Releasing Spears*, Seventeenth Printing, cover page, and pp. 1 through 19 (Jun., 1994), Bowen Tools, Inc.

*Instruction Manual, Bowen Simplex Packer Retrievers*, Ninth Printing, cover page, and pp. 1 through 13 (Sep., 1991), Bowen Tools, Inc.

* cited by examiner

*Primary Examiner*—Frank Tsay
(74) *Attorney, Agent, or Firm*—Akin Gump Strauss Hauer & Feld LLP

(57) ABSTRACT

A packer retriever having a grapple body rotatably and slideably coupled to a mandrel directly attached to a milling tool can engage a packer (or extension thereof) having a substantially smooth I.D. in a wellbore while the packer is milled. The mandrel rotates in a central opening through the grapple body. The grapple body does not rotate when released from teeth of a nut on the mandrel and can remain engaged to the packer (or the extension) as milling proceeds. The mandrel includes a specially designed shoulder and the grapple body includes a specially designed bearing, both casehardened, which allow the mandrel to rotate constantly while reducing the effects of wear. The packer retriever remains in the engaged position to prevent the packer from falling if it breaks loose while milling. The packer retriever can transfer torque to the packer and can be engaged and released multiple times.

24 Claims, 4 Drawing Sheets

PACKER RETRIEVER

CROSS-REFERENCE TO RELATED APPLICATIONS

Not applicable.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention is related to retrieving packers and their extensions from wellbores and, in particular, milling a packer with a packer retriever engaged to the packer or its extension without requiring rotation of a grapple of the packer retriever.

2. Description of the Related Art

To retrieve a packer, prior packer retrievers have to exit the inside of the packer. These packer retrievers cannot engage the smooth bore of the packer and allow for rotation while milling, but must completely exit the packer. Rotation is necessary because the packer retriever is tied directly or constructed to turn with the milling tool, and rotates underneath it.

Slips on the outer edge of the packer hold the packer in place. Typically, the outer part of the packer and slips (e.g., the outer ½-inch) are milled away using a hollow-type or "washpipe" milling tool, allowing the packer to become loose for retrieval. Other types of milling tools, such as a solid milling tool without a bore (i.e., without an inside diameter or I.D.), also can be used. These tools are used to mill the packer until it breaks loose. More information on packer retrievers can be found in Instruction Manual No. 5/2710, entitled "Bowen Simplex Packer Retrievers," by Bowen Tools Division of IRI International Corporation (National Oilwell), September 1991, which is incorporated by reference herein in its entirety.

Today, because smooth bore extensions (e.g., tubing or pipe) often hang off the bottom of the packer, an even longer tool holding a packer retriever would be required to retrieve the packer and the extension. For example, a 30 foot piece of tubing hanging off the bottom of the packer might require a 35 foot extension on the milling tool to enable the packer retriever to exit the lower end of the tubing. This is because milling can proceed only if the packer retriever completely exits the tubing, as indicated above, and rotates along with the milling tool. Therefore, there is a need to engage a smooth I.D. of a packer or its extension without having to exit the packer or the extension to reach open hole below.

One type of device, the so-called "ITCO"-type releasing spear, can be used to engage a smooth I.D. of a packer or its extension. Once it has passed through the packer, however, this releasing spear is forced to rotate freely with the hollow I.D. milling tool, as described above, to which it is attached directly. If the milling tool rotates at 60 turns per minute, then the releasing spear also turns at that same rate and does not wear on anything. If the rotating releasing spear instead were engaged to the smooth I.D. of the packer or its extension to be retrieved, then material would wear and burn from the contact as the spear rotated. The releasing spear would not last if 6 to 8 hours were required to mill the packer. This would happen if the spear were not allowed to remain stationary during milling. More information on ITCO-type releasing spears can be found in Instruction Manual No. 5/2300, entitled "ITCO Type Bowen Releasing Spears," by Bowen Tools, Inc., June 1994, which also is incorporated by reference herein in its entirety.

Because of such problems, the typical spear is attached to a milling tool having a slip mechanism provided. A bearing typically is used on the inside of the milling tool as the slip mechanism. The slip mechanism requires use of the hollow-type milling tool, for example, as shown on page 5 in the aforementioned instruction manual entitled "Bowen Simplex Packer Retrievers." If, however, the packer retriever could exit the I.D. of the packer or its extension, then either a solid or a hollow milling tool can be used. History has shown that hollow milling tools sometimes do not perform properly. For example, the milling tool and packer may have to be jarred or otherwise manipulated to remove it from the hole. This may be because a slab of material remains after partial milling on the outer one-half inch of the packer or something in the packer has become loose, creating drag or an immovable obstacle. Typically, success can be achieved better with a solid milling tool, which is flat on the bottom with perhaps just enough room for a shaft to come out to hold onto the tool. But, assuming open hole cannot be reached and a smooth I.D. must be engaged, then something must remain stationary, usually the spear, while the milling tool turns.

To resolve or reduce the effects of the above or other problems, a packer retriever is needed that can run with a solid milling tool and engage the smooth I.D. of the packer or its extension to be retrieved. Such a tool would not use the standard slip mechanism or have the spear remain stationary while remaining engaged on the smooth I.D of the packer or its extension. The tool must remain in the engaged position during operation.

SUMMARY OF THE INVENTION

Embodiments of the invention feature a packer retriever that can engage a packer or its extension having a substantially smooth inside diameter for retrieval from a wellbore. The packer retriever includes a grapple, grapple carrier, and a mandrel. The grapple and the grapple carrier form a grapple body. The grapple body is rotatably coupled to the mandrel, which is inserted through the grapple body and is attached directly to a milling tool. The grapple body is inserted in or through a bore of the packer to engage the packer or an extension thereof before the packer is milled. The packer retriever allows the mandrel to rotate constantly while the grapple body remains stationary during milling. The packer retriever can remain in the engaged position to prevent the packer from falling if the packer breaks loose from milling. The packer retriever can transfer torque to the packer, if desired or required, and can also be engaged and disengaged or released multiple times.

Embodiments of the invention feature a releasing mechanism in which torque is transferred to a packer retriever such that a compressive force is applied to a portion of the packer retriever, making it easier to release the packer retriever from the packer or its extension.

Embodiments of the invention feature a packer retriever having a grapple body that does not rotate when released below from teeth on a nut of a mandrel on which the grapple body is rotatably coupled. The grapple body does not rotate during a milling procedure on a packer, but with the nut engaged to the grapple carrier, the grapple body does rotate while releasing from the packer by effectively unscrewing from the packer I.D. These embodiments include a shoulder and bearing on the grapple body that allow the mandrel, but not the grapple body, to rotate while reducing the effects of wear.

Embodiments of the invention feature a packer retriever adapted for use with a milling tool in a wellbore. The packer retriever includes a grapple body having a central opening and external teeth (wickers) on a grapple for engaging inside a bore of a packer. The packer retriever also includes a mandrel having a shaft coupled directly (e.g., screwed) to the bottom of the milling tool. Alternatively, a stinger, which is a separate part or extension (i.e., of the shaft) can be installed between the milling tool and the packer retriever to regulate the distance of the tool below the milling tool. The shaft typically has a smooth external surface adapted to extend through the central opening to permit rotation and/or vertical movement of the shaft relative to the grapple body while the external teeth of the grapple are engaged inside a bore of a packer. In these embodiments, the grapple teeth have an external diameter sized for entry into and positioning in the bore of the packer or its extension, if any, upon application of a downward force on the grapple body for catching the packer to prevent it from falling while the packer is milled.

BRIEF DESCRIPTION OF THE SEVERAL VIEWS OF THE DRAWINGS

A better understanding of the present invention can be obtained when the following detailed description of the preferred embodiment is considered in conjunction with the following drawings, in which.

DETAILED DESCRIPTION OF THE INVENTION

In accordance with an embodiment of the invention, a packer retriever is designed to internally engage a packer or its underneath extension (e.g., tubing, pipe, or the like), if any, for retrieval from a wellbore. The packer and its extension are assumed each to have a substantially smooth inside diameter (I.D.). The packer retriever includes a mandrel, which couples to a milling tool, and a grapple body to form an assembly used to mill the packer and retrieve the packer and its extension. The packer retriever allows for constant rotation of the mandrel attached to the rotating milling tool while the packer is milled. To construct the assembly, a shaft of the mandrel is inserted through a grapple and a grapple carrier that form the grapple body of the packer retriever. The grapple body is rotatably coupled to the mandrel, which is fixedly coupled, in turn, to the milling tool for milling the packer before retrieval. The grapple and the grapple carrier are keyed to each other, which allows linear or vertical motion of the grapple body up and down relative to the mandrel while preventing the grapple and grapple carrier from rotating with respect to each other. While the milling tool mills the packer, the packer retriever can remain in the engaged position inside the packer or its extension to prevent the packer and extension from falling if the packer breaks loose during milling. The packer retriever can transfer torque to the packer if required and the grapple body can be engaged and disengaged or released multiple times from the packer or its extension, if needed. To ease release of the packer retriever from the packer or its extension, torque can be transferred to the grapple body such that a compressive force is applied to the grapple, which loosens the grip of the grapple from the I.D. of the packer for unscrewing the grapple.

Figure 1:
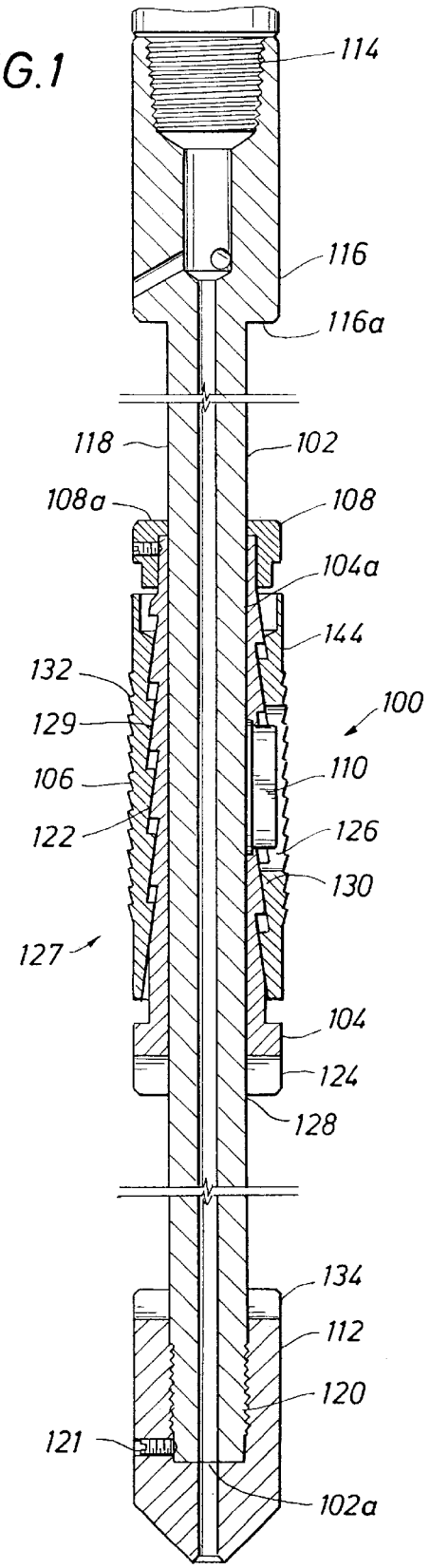
FIG. 1 illustrates a cross-section of a packer retriever in accordance with an embodiment of the invention.

FIG. 1 illustrates a cross-section of a packer retriever 100, in accordance with an embodiment of the invention. The packer retriever 100 includes a mandrel 102, grapple carrier 104, grapple 106, bearing 108, key 110, and nut 112. The mandrel 102 is the main body of the packer retriever 100. It includes a tool joint connection 114 on top for direct attachment to a milling tool, a shoulder 116, an outside diameter (O.D.) section or shaft 118, and threads 120 on the bottom for attachment of the nut 112. The grapple carrier 104 has a smooth I.D. 104*a*, a helical tapered section 122 on an O.D., and teeth 124 on the bottom for engagement to the nut 112, which is more clearly illustrated in FIG. 2, corresponding to the embodiment shown in FIG. 1. The bearing 108 (e.g., a cap) is attached to the top of the grapple carrier 104, for example, by threaded attachment and set screws, and provides a corresponding shoulder surface 108*a* to a shoulder surface 116*a* of the shoulder 116 on the mandrel 102 just above it. The shoulder 116 and the bearing 108 allow a downward force to push the grapple 106 into and through a bore of the packer or its extension, as will be described below. The bearing 108 serves as a load bearing, load distribution, and flat wear-surface for pushing the grapple carrier 104 before and while milling.

The grapple 106 and the grapple carrier 104 form a grapple body 127 (e.g., a generally cylindrical body) having a longitudinal central opening 128. The grapple 106 includes a helical tapered section or tapered wedge 129 on its I.D. that matches the similar, but complementary, helical tapered section or tapered wedge 122 on the O.D. of the grapple carrier 104. The I.D. of the grapple 106 is basically threaded with a similar profile to the grapple carrier 104 so that they can be threaded together using the tapered sections 122 and 129 while still allowing a wedge action to occur, as will be described below. The grapple 106 has a primary cut or slot 130 (see FIG. 2) on one side that is generally aligned parallel with, and displaced from, a keyway 126 (e.g., a milled keyway) of the grapple 106, as shown in FIG. 2.

Figure 2:
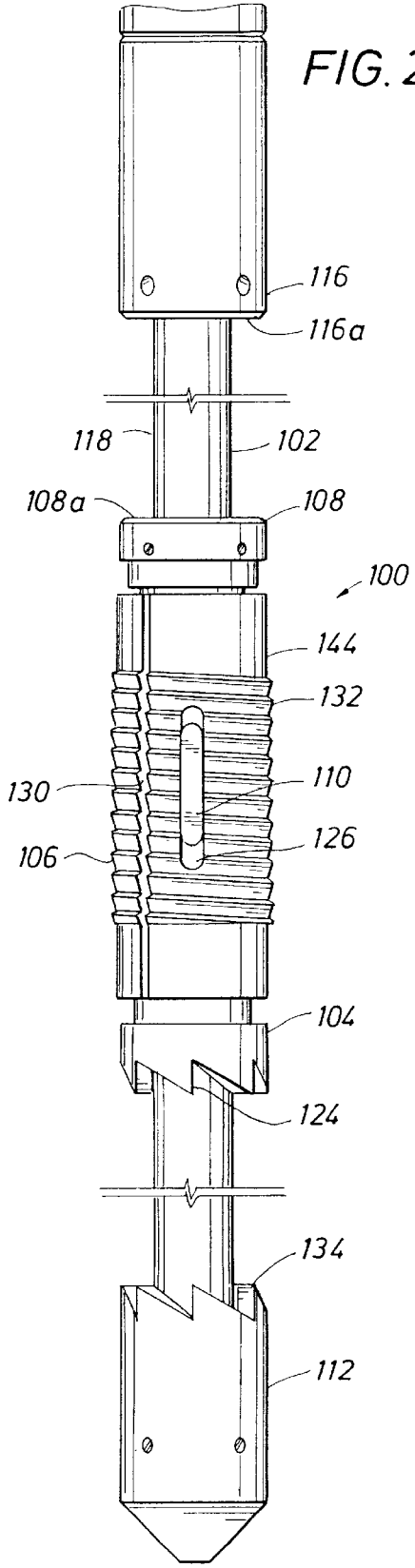
FIG. 2 illustrates another view of the packer retriever of FIG. 1.
Figure 7:
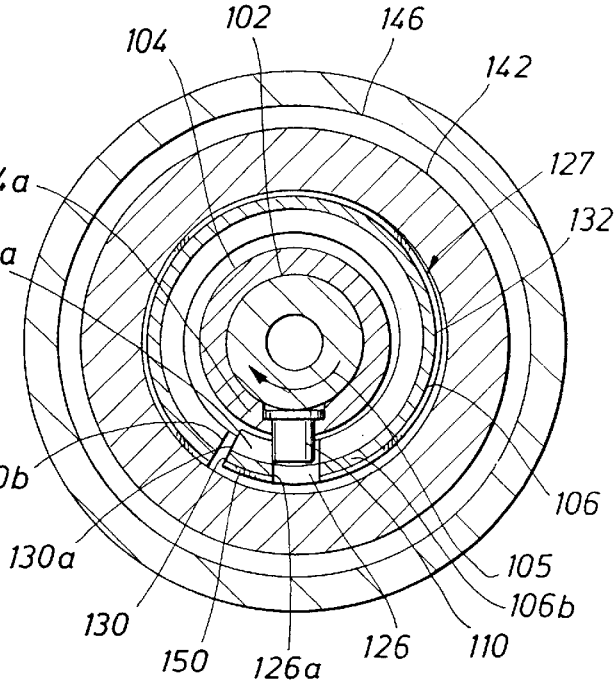
FIG. 7 illustrates a cross-section of the packer retriever of FIG. 1 showing details of the release operation of FIG. 6.

The keyway 126 is cut in the grapple 106 for placement of the key 110, as shown in FIGS. 1, 2, and 7. The key 110 is, for example, "T"-shaped, as seen best in FIG. 7, and is installed before assembly with the mandrel 102 on the grapple carrier 104 to prevent relative rotation between the grapple carrier 104 and the grapple 106. The key 110, besides preventing rotation between the grapple carrier 104 and the grapple 106, also transmits torque from the grapple carrier 104 to the grapple 106. The key 110 is part of a torsional load chain. Torque goes from the mandrel 102 through the nut 112 to the grapple carrier 104 via the teeth 124 on the nut 112 and teeth 134 on the grapple carrier 104, and through the key 110 to the grapple 106, as will be described in more detail below.

There are external angled teeth or wickers 132 on the O.D. 144 of the grapple 106 for engagement with the packer or its extension downhole in the wellbore (not shown in FIGS. 1 and 2). The wickers 132 are machined in the left-handed direction to prevent inadvertent release of any tool joints in a typical drill string when drilling and when releasing the packer retriever from the packer or its extension, if required or desired. The left-hand wickers 132 allow for releasing from the packer with right hand rotation, as will be described in more detail below.

The nut 112 on the bottom of the mandrel 102 includes the teeth 134 on top that match the teeth 124 on the bottom collar of the grapple carrier 104 for engaging and transferring torque to the grapple body 127 on right-handed or clockwise rotation looking down the wellbore. The teeth 124 on the bottom of the grapple carrier 104 and the teeth 134 on the top of the nut 112 could be helical gear-, square- or triangle-shaped teeth. Helix-shaped teeth are ideal to transfer torque. The right-handed threads 120 and set screw(s) 121 (FIG. 1) of the nut 112 prevent rotation while the nut 112 transfers torque to the grapple body 127 when the grapple body 127 is engaged to the packer or its extension. The nut 112 is tapered on the bottom to assist in entering the packer bore, as will be described below.

Embodiments of the packer retriever 100 can be constructed according to the exemplary non-limiting specifications shown in Table I. By way of explanation of Table I, the "size" of the grapple is equal to the I.D. or bore of the packer the grapple is intended to engage. In one embodiment, the smallest size grapple or the smallest I.D. packer can be, for example, 3¼ inches. The grapple O.D. 144, which includes the wickers 132, can be larger than its size by ⅛ inch, for example, 3⅜ inches, in this particular embodiment. The grapple squeezes down as it passes into the packer bore. The maximum O.D. of any part of the tool other than the grapple then can be, for example, 3⅛ inches. This O.D. is ⅛ inch smaller than the minimum packer I.D. or bore to allow the tool to pass through that I.D., as will be discussed further below. For the grapple having 3¼ inch size and 3⅜ inch O.D., the ⅛ inch difference means that grapple O.D. is always ⅛ inch larger than the nominal grapple size in this embodiment. This difference between the O.D. 144 and the size of the grapple 106, in general, is termed the "prebite."

In Table I, the free stroke refers to the distance the grapple carrier 104 can move relative to the mandrel 102, or visa versa, without engaging the teeth. The smallest I.D. of the mandrel 102 and nut 112, designated as 102*a* in FIG. 1, can be ⅜ inch in one embodiment. Also in Table I, the tensile strength of the mandrel 102 is the calculated theoretical tensile yield point of the material making up the mandrel 102 at the nut 112 threads. The torsional yield is the yield torque of the mandrel 102/nut 112 connection. Although specific dimensions and characteristics are presented in Table I, other dimensions and/or characteristics are contemplated in other embodiments, as will be appreciated by those skilled in the art. These other embodiments are meant to be included within the scope and content of the present invention.

TABLE I

| | |
|---|---|
| O.D. of the grapple | 3⅜ to 6 inches — For reference, the grapple O.D. is ⅛ inch larger than its "size." |
| Size of the bore of the packer | 3¼ to 6 inches (i.e., minimum size grapple is 3¼ inches) |
| Overall length from top of mandrel to bottom of nut | 40½ inches (with a 12 inch free stroke of the grapple carrier), although free stroke can be varied by design. |
| Free stroke length of grapple carrier on shaft between the nut and the shoulder | 12 inches |
| I.D. of the mandrel and of the nut | ⅜ inch |
| Wicker Lead | 1½ inches |
| Tensile Strength @ yield | 249,000 lbs. |
| Maximum Makeup Torque between mandrel and nut | 1,450 ft-lbs. (50% yield) |
| Torsional Yield | 2,900 ft-lbs. of nut to mandrel connection. |

Figure 3:
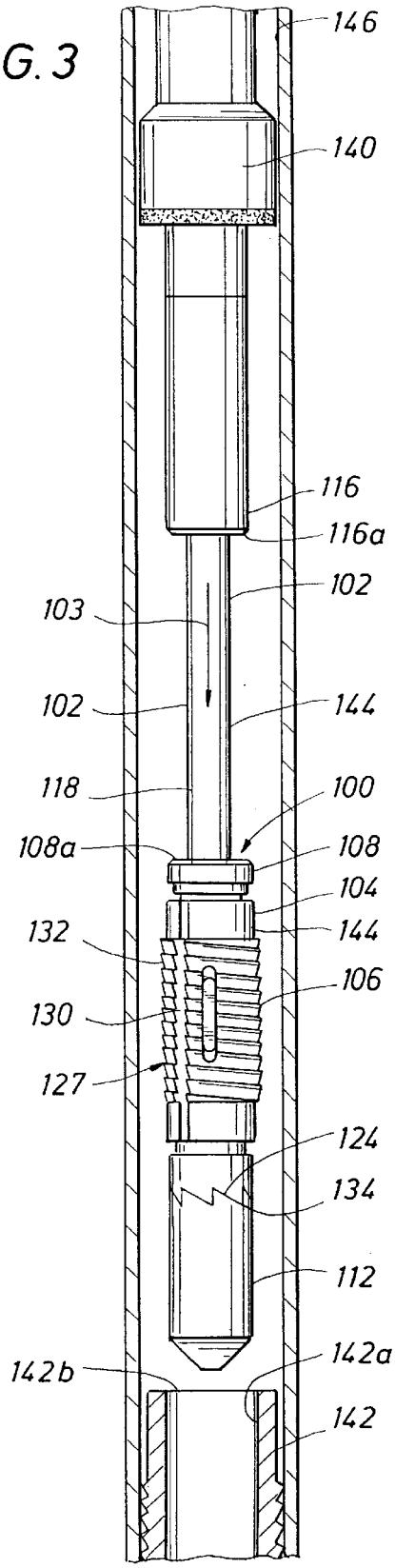
FIG. 3 illustrates the packer retriever of FIG. 1 as it is about to enter a packer.

Referring to FIG. 3 and Table I, the typical range for the I.D. of the packer 142 is 3¼ to 6 inches. This range could be covered by a few different O.D. (and/or sized) grapples 106 (e.g., 3⅜ to 6⅛ inches in O.D.). Different grapples 106 could be designed to match any I.D. of a bore 142*a* of a packer 142, as long as the O.D. of the grapple 106, including the wickers 132, is larger than the I.D. of the packer 142 while the grapple 106 is still capable of being forced into the bore 142*a* of the packer 142. The grapple 106 might be the only portion of the assembly that needs to be varied in design for implementation in different retrieval operations. In one embodiment, the grapple 106 has an O.D. 122 of 3⅜ inches (with 3¼ inch size), as in Table I, for a 3¼ inch I.D. packer 142. Again, this is a ⅛ inch prebite tool. Other tools could be designed with different prebites. For example, if the packer 142 had a 4-inch I.D., then the grapple 106 could be fabricated larger in O.D. (e.g., 4⅛ inch with a size of 3 15/16 inches), so that it could fit and drag/engage within the 4-inch I.D. of the packer bore 142*a* and compress with a 3/16 inch prebite. Note that other packers exist with an I.D. bore as small as 1½ inches, and the present invention can be designed to work with these and other packers, as will be appreciated by those skilled in the art.

Typically, the grapple 106, with a given O.D., can work with the I.D. of the packer 142 or its extension for which the size of the grapple 106 is matched, plus or minus a given amount, for example, 1/16-inch, as long as the O.D. 144 of the grapple 106 with the wickers 132 is always larger than the I.D. of the packer bore 142*a*. This "catch range" (e.g., ±1/16 inch) from the nominal size means, for example, that a 3¼ inch size grapple (and O.D. 3⅜ inches) should perform well with a packer I.D. range of 3 3/16 to 3 5/16inches. Thus, the grapple 106 for a given packer I.D. should be dimensioned as accurately as possible. In other embodiments, grapples can be designed to work with packer I.D.s that vary by an amount different than ±1/16 inch. The pitch of the wickers 132 typically would remain the same for any given size or O.D. grapple, although this could be varied in different embodiments as well.

Referring again to FIGS. 1–3, the long, small O.D. portion of the mandrel is the shaft 118 of the mandrel 102. The length of the shaft 118 determines the free stroke of the tool. It does not "adjust" the location of the grapple body 127. No matter how long the shaft 118 is, the shoulder 116 of the mandrel 102 pushes the grapple body 127 inside of the packer 142. The shaft 118 extends below the grapple body 127 upon entering the packer 142 and does not affect placement of the grapple body 127.

If an extension is run between the packer retriever 100/mandrel 102 and the milling tool 140, it would traditionally be called a "stinger" and is a separate part from the retriever 100 and the milling tool 140. The stinger will adjust the distance between the retriever 100 and the milling tool 140, which will adjust the grapple body 127 placement.

Figure 4:
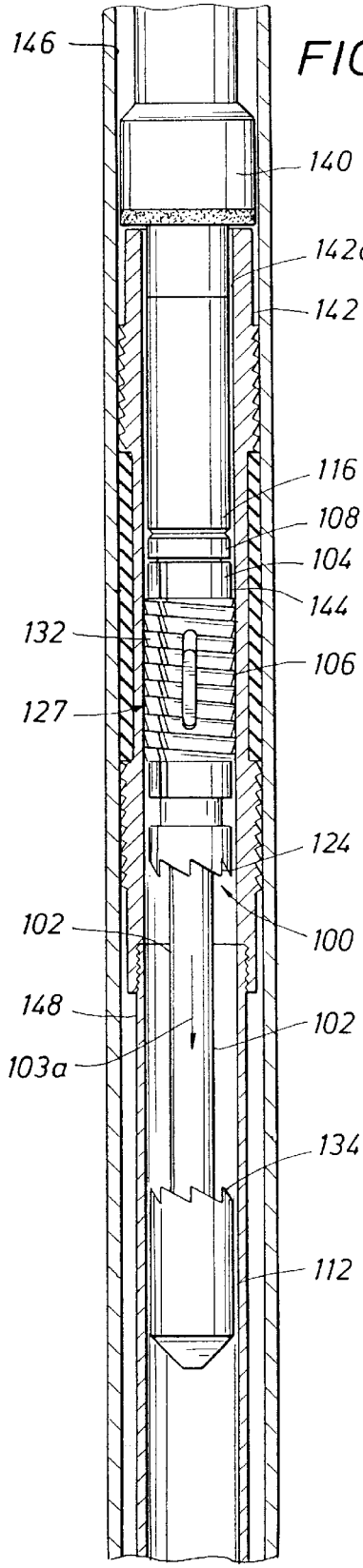
FIG. 4 illustrates the packer retriever of FIG. 1 prior to milling the packer with a grapple of the packer retriever engaged to the packer.

As illustrated in FIGS. 3 and 4, the assembled packer retriever 100 is placed far enough under a packer milling tool 140 to which the mandrel 102 is attached to locate the grapple 106 inside the bore 142*a* of the packer 142 to be retrieved before the packer 142 is milled. The length of the shaft 118 (FIG. 3) between the milling tool 140 and the nut 112 can be varied (e.g., by using stingers designed to be of different predetermined lengths) to be able to adjust the location (and the up and down free stroke length) of the grapple body 127 relative to the milling tool 140.

The grapple 106 and the grapple carrier 104, although locked together in a manner that prevents relative rotation, still allow limited vertical movement of the wickers 132 relative to the tapered wedge section 122. This is accomplished by locating the key 110 in the keyway 126, as described above. The grapple carrier 104 has a smooth I.D. and is free to rotate and slide on (i.e., it is rotatably coupled to) the shaft 118 of the mandrel 102 unless the teeth 124 and 134 are engaged between the grapple carrier 104 and the nut 112, as shown in FIG. 3. The I.D. of the grapple carrier 104 typically is thousandths of an inch larger (e.g., approximately ten thousandths) than the O.D. of the mandrel 102.

The tapered helical or tapered wedge section 122 on the O.D. of the grapple carrier 104 expands the wickers 132 within the bore 142*a* of the packer 142 when the grapple 106 is forced or pulled up, as will be apparent upon examination of FIG. 1. If the grapple 106 is pulled up (without rotation) when it is in the bore 142*a*, its tapered helix portion is expanded for tighter engagement of the grapple 106 to the bore 142*a* of the packer 142. Only right-handed rotation and movement up and down are required for complete operation of the packer retriever 100, although it is contemplated that an equivalent left-handed system could be implemented in other embodiments, as will be appreciated by those skilled in the art. These other embodiments are included in the scope and content of the present invention.

A method of operating the packer retriever 100 is now described, in accordance with an embodiment of the invention. The entire assembly, including, but not limited to the milling tool 140 and the packer retriever 100, is lowered into the wellbore (or casing in a borehole) 146, as shown in FIG. 3. As indicated by arrow 103, the assembly is lowered until the nut 112 (i.e., the mandrel 102) contacts a top 142*b* of the packer 142. Rotation, if any, of the milling tool 140 and the mandrel 102 should be ceased or slowed to a minimum while the packer retriever 100 enters the packer bore 142*a* as the assembly is lowered further. If the grapple body 127 is spinning or rotating on the way down prior to entering the packer 142, it will stop usually when it hits the packer 142. Typically, one might not want to rotate until the grapple 106 is set inside the packer 142 or its extension. Even with rotation, however, when the grapple carrier 104 hits the top of the packer 142, the mandrel 102 will continue down and the grapple 106 will stay on top of the packer 142 until the shoulder 116 shoves the grapple 106 into the bore 142*a* of the packer 142. At that point, the teeth 124 on the grapple carrier 106 and the teeth 134 on the nut 112 are separated, and the downward motion or the weight being set down by the shoulder 116 on the bearing 108 will affect the grapple 106 and the grapple carrier 104.

As the grapple body 127 makes contact with the packer 142, it slides up the mandrel 102 until the shoulder 116 makes contact with the bearing 108 at the top stroke position of the grapple body 127 on the shaft 118. The shoulder 116 compresses the grapple 106 and forces the grapple body 127 to slide down into the packer bore 142*a* of the packer 142. As milling progresses, the grapple body 127 moves further down within the bore 142*a* of the packer 142 by the downward force on the bearing 108. At that point, despite moving down within the bore 142*a*, the grapple 106 has sufficient grip or drag on the inside of the packer 142 to prevent the packer 142 from dropping in case it breaks free of the wellbore, casing or hole 146, and the mandrel 102 can be rotated freely for milling with the milling tool 140.

FIG. 4 shows the assembly when the milling tool 140 is about to contact the packer 142, and after the grapple body 127 has entered the packer 142. The grapple 106 engages its external teeth (i.e., the wickers 132) on its O.D. 144 within the packer 142. The spring-like characteristic and engagement of the grapple 106, as the grapple 106 is compressed and pushed through the bore 142*a* and the cut 130 is closed down, makes use of the differential pre-bite discussed above. It may take, for example, a couple of hundred pounds of force to push the grapple 106 into and position it within the packer 142. If, at any point, however, an upward force is applied, the grapple 106 will grab onto the I.D. of the packer 142 or its extension, if any, depending on which the grapple 106 is within when the upward force is applied. This is because the wickers 132 are angled such that the grapple 106 tends to engage more if an upward force is applied to the mandrel 102 when the teeth 134 of the nut 112 contact the teeth 124 of the grapple carrier 104, as discussed above. The greater the upward force on the mandrel 102, the more the tapered helix 122 will expand on the tapered helix 129 of the grapple 106, which causes the grapple 106 to engage the I.D. of the packer 142 further.

Figure 5:
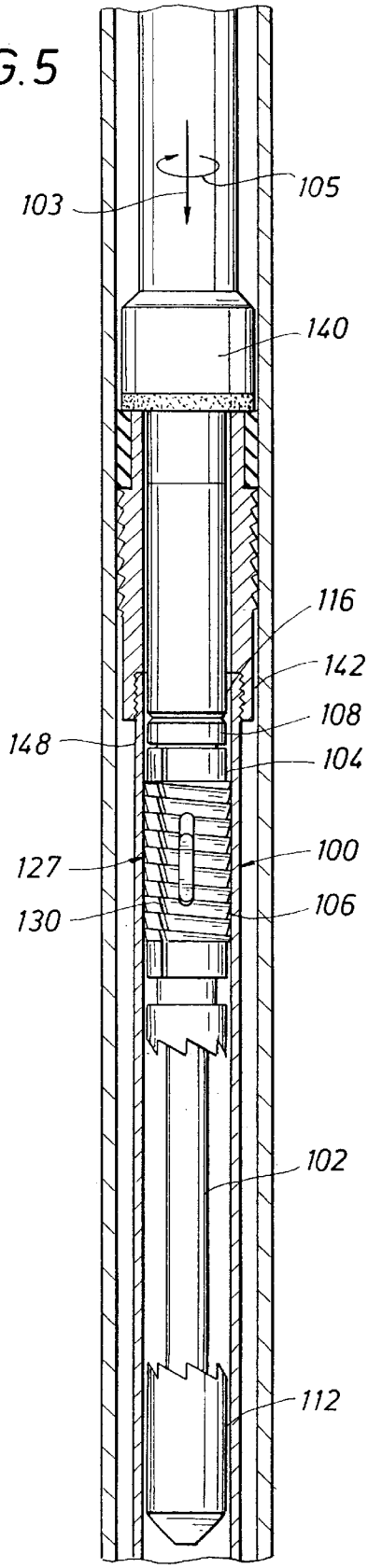
FIG. 5 illustrates the packer retriever of FIG. 1 during a milling operation.

Once the grapple 106 is fully positioned in the bore 142*a* and engages the I.D. of the packer 142 or its extension 148, as shown in FIG. 4, rotation of the milling tool 140 and the mandrel 102 may start or resume for milling the packer 142. The milling tool 140 rotates and mills the packer 142 at a chosen speed and weight, as indicated in FIG. 5 by the arrows 103 and 105. The chosen speed and weight should be predetermined and/or adjustable according to knowledge of the operation.

In FIG. 5, the packer 142 is shown partially milled away and the shoulder 116 of the mandrel 102 continues to push down on the bearing 108 as milling progresses. For example, a ½-inch (or any other length) vertical section of the packer 142 could be milled away in a ring from its top, which would result in the grapple 106 being pushed by the shoulder 116 further down the bore 142*a* of the packer 142 or its extension 148 by the same distance. If the packer 142 breaks free, the mandrel 102 can be pulled up to retrieve the packer 142. However, if an operator decides to pull the packer retriever 100 up prematurely before the packer 142 is free, the upward moving mandrel 102 would cause the grapple 106 to engage the I.D. of the packer bore 142*a* further. The harder the resulting pull on the packer 142, the more the grapple 106 would try to expand and bite into or engage the I.D., as discussed above.

While milling, the assembly generally should be moved downwardly only. It is also advisable not to raise the assembly while rotating at high speeds. If the assembly were raised by an amount greater than the free stroke length of the grapple carrier 104 on the mandrel 102 while rotating at high speed with the grapple body 127 inside the bore 142*a* of the packer 142 or its extension 148, the teeth 124 and 134 would engage and torque would be transferred to the grapple body 127, likely causing damage.

While the mandrel 102 is rotating and the packer 142 is being milled, well fluids are circulating (not shown) to remove shavings, cuttings, and other milling debris from the hole 146. Typically, these fluids are very thick or dense well fluids or drilling mud that carry the cuttings out. The fluids constantly circulate during the entire milling operation. This allows for heat transfer to occur and avoids thermal gradients. Circulation holes (not shown in drawings) can be provided in the shoulder just above the bearing 108 surface for the well fluid circulation. These holes, in addition to the I.D. 102*a* (e.g., ⅜ inch) of the mandrel 102, can equate to an approximate effective I.D. for well fluid circulation of about 1 inch. A hole can be included in the O.D. of the mandrel 102 to allow the well fluids to circulate within the I.D. of the grapple carrier 104. This will keep the I.D. of the grapple carrier 104 coated with a constant fluid film for lubrication between it and the O.D of the mandrel 102.

The bearing 108 includes a hole, through which the mandrel 102 passes and can rotate. A steel bearing for the bearing 108 and a steel shaft for the shaft 118 of the mandrel 102 with a snug fit, for example, could be used. The bearing 108 has an I.D. wider than the O.D of the mandrel 102. The difference in these diameters allows the mandrel 102 to freely turn. The shoulder 116 and the bearing 108 both have wear surfaces that bear on each other during milling. A heat process can be used to treat the top 108*a* of the bearing 108 and the O.D. of the shaft 118 (i.e., the wear surfaces) so that they do not wear out or only wear out over a long period of time. A hard metal coating can be applied on the top shoulder surface 108*a* of the bearing 108 and on the bottom shoulder surface 116*a* of the mating shoulder 116 on the mandrel 102. Also, the I.D. of the grapple carrier 104 and the O.D. of the mandrel shaft 118 are heat treated to reduce wear and extend life. For hardening the wear surfaces of the shoulder 116 and the bearing 108, typically an area is undercut in both in which the hard metal coating is braised and ground and polished down to a very smooth, flat surface and finish. These undercuts (not shown) are machined grooves in the mandrel 102 and the bearing 108 where they contact each other. The groove is then filled with the hard metal coating and ground and polished. The surfaces that result are able to carry high load and wear slowly. These surfaces also are coated with the circulating well fluids for lubrication. Between the lubrication and the hardening by heat treatment, although the clearance between the I.D. of the grapple carrier 104 and the mandrel 102 typically is only ten thousandths of an inch, not much wear is expected between the mandrel 102 with its shoulder 116 and the grapple carrier 104. The packer retriever 100 thus can withstand hours of rotation without wearing out. Because the grapple body 127 can remain stationary while the mandrel 102 freely rotates, a standard solid or washpipe milling tool can be used with the present invention.

FIG. 5 shows the grapple 106 engaged to an extension 148 (e.g., tubing, pipe, etc.) extending below the packer 142. The extension 148 may have approximately the same I.D. as the bore 142*a* of the packer. It is to be understood that the grapple 106 in FIG. 5 could have been shown engaged instead to the packer 142 itself for retrieval rather than the extension 148. As will be appreciated by those skilled in the art, whether the grapple 106 is engaged to the packer 142 or the extension 148, the packer retriever 100 would be chosen or designed, if necessary, to account for any possible variation between the I.D. of the bore 142*a* of the packer 142 and the I.D. of the extension 148. The ability to engage the packer 142 or the extension 148 for retrieval depends on the relative lengths and sizes of the packer 142, the grapple body 127, the shaft 118, the stroke length of the grapple 106 and the grapple carrier 104 along the shaft 118, as well as the O.D. 144 of the grapple 106, the size and pitch of the wickers 132, the size of the cut 130, the I.D. of the bore 142*a* or the extension 148, the desired retrieval method, and other factors, as will be appreciated by those skilled in the art.

As milling proceeds, the grapple 106, although engaged with the bore 142*a* of the packer 142 or the I.D. of the extension 148, and the grapple carrier 104 continue to move down. As the grapple carrier 104 is pushed down, it drags on the I.D. of the packer 142 or the extension 148. It will continue to move down until the mandrel 102 is pulled up and the nut 112 engages the teeth 124 when the packer 142 breaks free for retrieval of the packer 142. Engagement of the grapple 106 may be tested at any time during the milling operation before the packer 142 breaks free by stopping rotation and lifting the entire assembly. Release of the grapple 106 from the packer 142 or its extension, if any, however, may be necessary or desirable at some point during or prior to completing the milling or retrieval operation. The grapple 106 may be released from the packer 142 or its extension 148 by first setting or bumping down and lifting upwardly on the mandrel 102 on the assembly as lightly as possible and rotating to the right (i.e., clockwise, looking down the borehole 146), as shown by the arrows 105 and 107 in FIG. 6. Bumping down can be described as follows: once a high load has been pulled and the grapple has been set, a wedge force is created between the helix on the grapple carrier 104 and the I.D. of the grapple 106. Due to frictional forces, sometimes increased by part deflections, a "bump" or small downward impact is usually needed to separate the grapple 106 from the grapple carrier 104. Until their engagement is broken, the grapple 106 may not release easily. Typically, a bumper sub or slack joint would be run to allow the operator to bump weight down to release the engagement. Once released, the grapple 106 may be unscrewed from the packer 142. The grapple 106 can unscrew from the packer ID with little or no overpull and right hand rotation.

Figure 6:
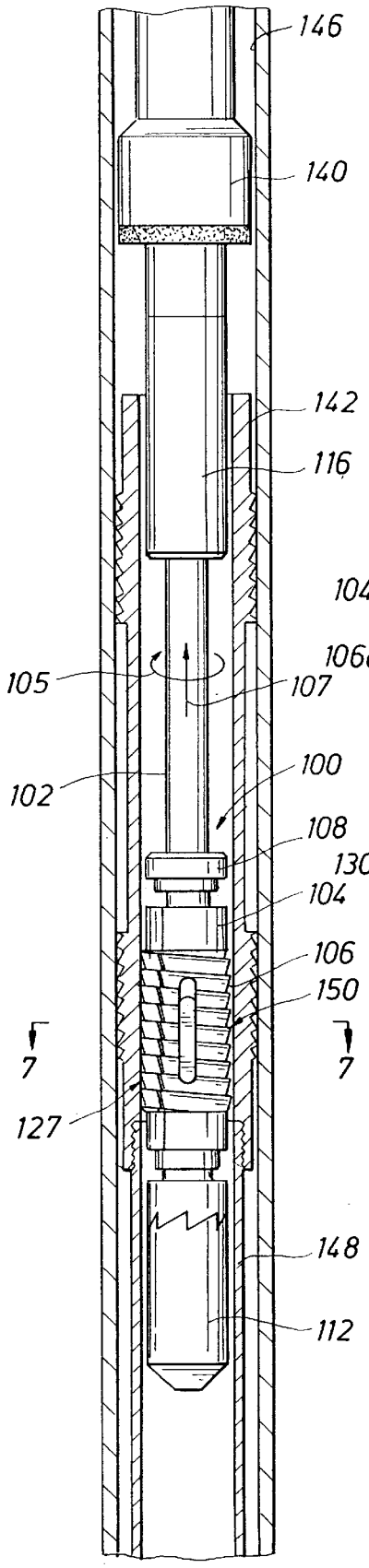
FIG. 6 illustrates the packer retriever of FIG. 1 being released in a release operation.

The grapple body 127 will tend to unscrew because of the wickers 132 of the grapple 106, which form left-handed threads. The grapple body 127 will unscrew by an amount equal to the lead of the wickers 132 for each rotation of the shaft 118. Note, the pitch is the width of the thread and the lead is the amount of travel that a thread makes in one revolution. When a thread has only one lead/start, the pitch and the lead are equal. If there is more than one thread start, the lead is greater than the pitch. The disclosed embodiment has a ⅜ inch pitch thread with four starts (i.e., four individual threads parallel to each other). Therefore, four starts means the lead is 1½ inches (or ⅜ inch times 4). When the grapple 106 is turned one revolution, it will unscrew by 1½ inches of travel. This reduces the number of rotations that are required to unscrew the grapple 106 from the I.D. of the packer 142. The clockwise rotation is usually necessary because of the wedging or spring-like action of the grapple 106. When rotation occurs to the right with a slow upward pull and load, the wickers 132 rotate to the right and unscrew themselves out of the packer bore 142*a*. FIG. 6 shows the grapple body 127 being unscrewed from the bore 142*a* of the packer 142, although this could have been shown instead with the grapple body 127 being unscrewed from the I.D. of the extension 148, or after some or much milling has occurred, as in FIG. 5.

The process of releasing the grapple 106 from the packer 142 involves raising the mandrel 102 such that the teeth 134 of the nut 112 engage the teeth 124 of the grapple carrier 104 to transfer right-hand torque to the grapple carrier 104 and thus to the grapple 106. The torque transfer allows the grapple 106 to be removed from the packer 142 (or the extension 148) while pulling straight upwardly. Note that releasing is unlikely to occur, if at all, with only straight upward pulling. The grapple 106 will only engage more tightly until the packer 142 or the mandrel 102 yields because pulling straight out would cause a greater bite or engagement of the wickers 132 into the bore 142*a* of the packer 142 (or the I.D. of the extension 148), as described, and might actually prevent release. Pulling straight upwardly, for example, could involve thousands or even hundreds of thousands of pounds (i.e., beyond the point where the tool would yield) whereas unscrewing might only involve a load of a few hundred pounds. Note that it is desirable to have as little load as possible to be lifted while releasing. The optimum load might be about 5 pounds more than it takes to lift the mandrel 102 and engage the teeth 124 and 134. The harder the tool is pulled up while releasing, the more torque will be required to unscrew the grapple because the upward pulling load is transferred radially through the helix into the grapple 106. Therefore, the grapple 106 bump down facilitates the release by releasing the wedge force on the grapple 106, followed by lifting up slowly, engaging the teeth 134 and 124, and rotating to the right to unscrew the grapple 106 out of the bore 142*a*.

After the bump down or jarring the mandrel 102 physically on the bearing 108 mentioned above, the nut 112 then continues to engage the grapple carrier 104 as the assembly is turned slowly to unscrew the grapple 106 and grapple carrier 104 from the packer 142. Normally, rotation only occurs when milling the packer 142 or releasing the grapple 106, although during milling, the grapple 106 and the grapple carrier 104 do not rotate, as does the shaft 118. However, normally the shaft 118 and the milling tool 140 are not rotated while pulling up the packer 142 unless a release is intended.

While milling or before the packer 142 breaks free, the grapple 106 can be engaged and disengaged or released from the packer 142 a multiple number of times, as needed or desired. Also, if necessary, while engaged, the packer retriever 100 (i.e., the grapple 106) can transfer torque to the packer 142. The cross-section of FIG. 7 shows how the key 110 and the keyway 126 transfer torque clockwise (from the perspective of above the tool, i.e. looking downhole) from the mandrel 102 to the grapple 106 through an edge or side 126*a* of the keyway 126. The torque transfer via the nut 112 creates or widens a gap 150 between the wickers 132 of the grapple 106 and the I.D. of the bore 142*a* of the packer 142 (or the I.D. of the extension 148), and reduces the width of the cut 130, as shown in FIGS. 6 and 7 in comparison to FIG. 5. That causes the external diameter of the grapple carrier 106 to be reduced, which in turn releases the angled wickers 132 from engagement with the bore 142*a* of the packer 142. FIG. 7 is not drawn to scale and the size of the gap 150 is exaggerated for clarity.

The location of the key 110 and the keyway 126 facilitates the process of releasing and unscrewing the grapple body 127 from the packer 142 or the extension 148. The key 110 is located in a solid segment of the grapple 106 as opposed to being in one of the flex cuts of the grapple 106. It is also located in a solid segment of the grapple carrier 104. The key 110 is located generally towards one end of a solid segment 104*a* of the grapple carrier 104, and transmits the torque after the teeth 124 and 134 are engaged. The key 110 location on the grapple carrier 104 is picked to associate correctly with the desired key location on the grapple 106. The key 110 is placed to "pull" the grapple in rotation and not to "push" the grapple in rotation, as will be described below in more detail. "Pushing" the grapple tends to make the grapple expand and increases the torque required to release. "Pulling" the grapple tends to make the grapple pull in slightly (i.e. compress) and assists in releasing and reducing the torque required to rotate the grapple. The key 110 and the keyway 126 are located toward a side 130*a* of the primary cut 130 in the grapple 106. This position allows a natural closing force (like winding or compressing a spring) to be applied to the grapple 106 on right-handed rotation of the mandrel 102 that reduces the torque required to release the left-hand-threaded wickers 132 from the packer 142 (or from the extension 148). The closing force widens the gap 150 most extensively in the vicinity of the side 130*a*, with the width of the gap 150 tapering to a smaller size proceeding in a circular direction from the side 130*a* toward the key 110 and the keyway 126, and past them, opposite to the direction of the arrow 105 in FIG. 7. When torque is applied to the grapple 106 through the key 110, the wickers 132 on the O.D. of the grapple 106 actually unscrew from the I.D. of the packer 142, as described. The "compressive force" assists in releasing the grapple 106 by working to close the full length cut 130 on the grapple 106 and preventing the grapple 106 from binding while releasing. The "compressive force" reduces the torque required to release.

It could be said that from the position of the key 110, on rotation of the grapple body 127 due to the transmitted torque, the key 110 is effectively pulling the grapple 106 to a smaller diameter. Viewed from the top, as in FIG. 7, it is possible to see how the torque transfer and right-hand rotation, which moves the key 110 toward the left side of the drawing, attempts to close the primary cut 130. The cut 130 goes all the way through the grapple 106, and the key 110 is just far enough from the cut 130 and has enough of the material of the grapple 106 in front of it toward the side 130*a* to keep the grapple 106 from breaking when the torque is applied. This thin section between the key slot and the primary cut in the grapple carries all the torque from the key 110. If the section breaks, the key 110 would then move to the primary slot and begin "pushing" the grapple instead of "pulling" it. This would be considered a breakdown of the grapple 106. The thickness of material between the key slot and the primary slot is picked based on calculations that show that it is strong enough to carry loads at least as large as the torsional rating for the tool. This placement allows the grapple 106 to compress rather than expand during the release operation, and also avoids having to provide excessive torque to remove the grapple 106. If the key 110 were instead placed just within the primary cut/slot 130, and the torque applied, upon rotation of the grapple 106, frictional drag would occur between the grapple 106 and the bore 142*a* of the packer 142 (or the I.D. of the extension 148). This would cause a surface 130*b* of the primary cut 130 of the grapple 106 to be pushed, which tends to narrow the gap 150 instead of opening it. The grapple 106 would have a natural tendency to open instead of close, making the grapple 106 bite harder, as discussed above, and as will be appreciated by those skilled in the art upon examination of FIG. 7. In that case, the width of the gap 150 would decrease, which could in turn significantly increase the torque required to release the grapple 106. Note that although the word "gap" is used in reference to the gap 150, such a gap would likely not be easily observed. It is expected to be a very slight gap and somewhat localized just around the slot. The point is that with at least some overpull during the releasing operation, there is still a force pushing out on the grapple, but as long as the overpulls are not excessive, that force can be overcome in rotation.

Referring again to FIG. 7, advantageously, the key 110 and the keyway 126 are disposed instead between sections or segments 106*a* and 106*b* to avoid this problem. In the disclosed embodiment, the key 110 is integral with the grapple carrier, but could be a screw, bolt, or the like in other embodiments. Where to locate the key 110 is identified by determining where to locate the segments 106*a* and 106*b* of the grapple 106 such that the key 110 predominantly pulls on the section 106*b* although pushing the section 106*a* to cause a net spring-like compression of the grapple 106. In some embodiments, however, the key 110 can be disposed in the primary cut 130 of the grapple 106 if the primary cut 130 is made big enough to accommodate the key 110. If the key 110 is attached (e.g., fixedly attached by welding) to the side 130*a* of the primary cut 130, such embodiments would not require the keyway 126, as the cut 130 acts as a keyway. The key 110 would pull on the grapple 106 at the edge 130*a* upon right-handed rotation, thus applying a compressive force on the grapple 106 rather than an expansive force as would occur if the key 110 were not attached to the side 130*a*, but instead pushed against the side 130*b*. In still other embodiments, the key 110 and the keyway 126 can be disposed at positions anywhere along the circumference of the grapple 106, as long as there would be a net compressive force applied to the grapple 106 to expand the gap 150 rather than a net expansive force. In one embodiment, the key 110 and keyway 126 are disposed at an approximately forty-five degree position (shown as A in FIG. 7), such that the key 110 can be used to pull on approximately seven-eighths of the grapple 106 while only pushing approximately one-eighth. This disposition also yields a net compressive force. Note, however, that as the key 110 and the keyway 126 are positioned further and further away from the end side 130*a* along a direction opposite to the arrow 105 in FIG. 7, the net pulling or compressive force decreases and pushing or expansion increases.

Placing the key 110 in the more central locations of the grapple 106 also may be more desirable than placing it on the end side 130*a* because of structural material strength or yielding issues. When disposing the key 110 on the end side 130*a*, the strength of the materials required to accommodate the force necessary to compress the grapple 106 (i.e., the materials used to attach the key 110, such as welding material, as well as the material making up the grapple 106 itself), may be inadequate. So, the idea is to have the thickness of the small section between the key slot and primary slot made thick or wide enough to carry the load generated from the torque, as discussed. Nevertheless, it is desirable to place the keyway 126 and key 110 as close as possible to the primary cut 130 such that they are disposed in a position in which the size of the segment or section 106*a* can be minimized, and thus the gap 150 maximized nearby, and still have just enough material to hold the parts of the grapple 106 and the grapple carrier 104 physically together to prevent material failure. That position must be one in which pulling dominates pushing. Such positions can be determined by calculating the required component forces to apply to the grapple 106 at various positions along its circumference for producing net compression, as will be appreciated by those skilled in the art. For example, a simple method could be developed in which the tangential component of force is calculated at various points along the circumference of the grapple 106, which is the important component in producing compression. In this manner, the location of the tangential component that produces the optimal disposition of the key 110 and the keyway 126 for compression of the grapple 106 can be identified. The maximum torque expected to be required for release can be estimated. Based on the known moment arm from the centerline of the tool, the load on the O.D. of the grapple 106 required to generate the torque is calculated. The segment in front of the key 110 is then designed to carry the calculated load. This approach will be appreciated by those skilled in the art. Identification of the stresses at this relevant position in the grapple 106 where the key 110 is to be placed can be made, recognizing the requirement to make that portion (i.e., the section 106*a*) strong enough to hold the grapple 106 together and avoid failure.

Figure 8:
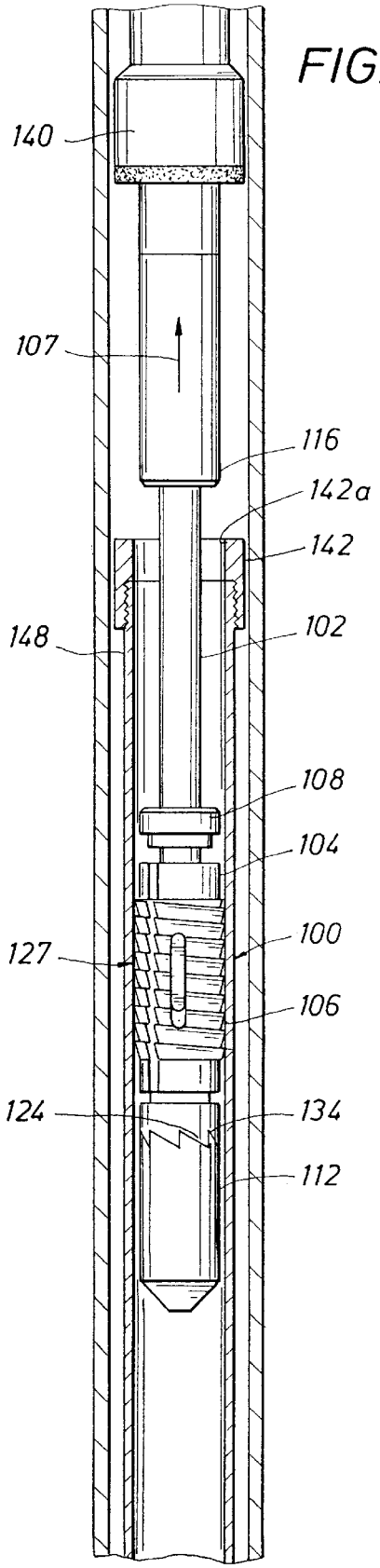
FIG. 8 illustrates the packer retriever of FIG. 1 retrieving the packer after milling is terminated or illustrates any time the packer retriever and packer are pulled up the wellbore.

We now refer to FIG. 8 and consider again retrieving the packer 142 rather than releasing the grapple body 127 from the packer 142, as in FIG. 6. After the milling operation has proceeded for a period of time, the packer 142 will break free of the borehole 146. Once free, it is possible to detect a drop in loading on the assembly, which provides an indication that it is time to pull the packer 142 out. It is recommended at this point for rotation to cease. The procedure is to pull hard and straight up without rotation, while during the release operation, the procedure is to pull up slightly and to rotate slowly, as described above. FIG. 8 illustrates the situation in which most of the packer 142 has been milled away and rotation has stopped. The assembly can be pulled up, as indicated by arrow 107 in FIG. 8. For retrieval, upward movement causes the nut 112 to engage the grapple carrier 104 holding onto the I.D. of the extension 148 (or the bore 142*a* of the packer 142). The teeth 124 and 134 are engaged to apply the upward force. What remains of the packer 142 and/or the extension 148, if any, thus can be removed from the wellbore or casing 146 because the grapple 106 is still engaged within the I.D. of the extension 148 (or the packer 142). It is better if the entire assembly then can be pulled out of the borehole 146 without any right-hand rotation to prevent the risk of releasing the packer retriever 100 from the extension 148 (or the packer 142), as shown in FIG. 6.

Although specific embodiments of a packer retriever have been disclosed herein, in fact, any type of packer retriever can be designed as long as it can grab the I.D. of the packer 142 or its extension 148, if any, when pulled up, and can slide through the packer 142 and not rotate when pushed down during milling. For example, an embodiment could be designed that allows left-handed rotation. In this embodiment, to remove the packer 142, the assembly is just pulled up. But, to release, rotation is made to the left (e.g., one turn to the left) because the grapple in this case would have right-handed threads on its wickers. The main idea is for a shaft (with or without a stinger) to be able rotate freely within a grapple body during milling while the grapple body can remain stationary and engaged to either the packer 142 or its extension 148.

The foregoing disclosure and description of the embodiments of the present invention are illustrative and explanatory thereof, and various changes in the components, elements, or parts, as well as in the details of the illustrated structures and construction and method of operation may be made without departing from the spirit and scope of the invention.

I claim:

1. A packer retriever adapted to be used with a milling tool in a welibore, comprising:

a grapple having a grapple body with a central opening and external teeth for ngaging inside a bore of a packer;

a mandrel having a smooth external surface adapted to extend through the central opening to permit rotation and/or vertical movement thereof relative to the grapple while the external teeth of the grapple are engaged inside the bore of the packer; and the grapple adapted to allow entry into and positioning thereof in the bore of the packer upon application of a downward force on the grapple body to support and prevent the packer from falling while milling the packer.

2. The packer retriever of claim 1, wherein, alternatively, an extension of the packer receives the grapple.

3. The packer retriever of claim 1, wherein upon upward movement and rotation of the mandrel, a release of the grapple from the bore of the packer is effected.

4. The packer retriever of claim 1, further comprising:

a bearing on an upper end of the grapple body for engagement by the mandrel during rotation of the mandrel.

5. The packer retriever of claim 1, wherein the grapple comprises a partial cylinder with a longitudinal opening therein to facilitate a compression thereof for releasing the external teeth (wickers) from engagement with the bore of the packer-upon the application of an upward force and rotation of the mandrel relative to the grapple.

6. The packer retriever of claim 5, wherein the rotation of the mandrel is in a right-hand direction or a left-hand direction.

7. The packer retriever of claim 1, wherein the grapple has an external diameter slightly larger than the internal diameter of the bore of the packer when the grapple is positioned external to the packer, but compressible upon a downward force being applied to the grapple body for effecting downward movement and gripping engagement of the grapple teeth with the packer bore.

8. A packer retriever for use in a wellbore, comprising:

a grapple body having a central opening and external teeth for engaging inside a bore of a packer; and a mandrel having a smooth external surface adapted to extend through the central opening to permit rotation and/or vertical movement thereof relative to the grapple body while the external teeth of the grapple body are engaged inside the bore of the packer;

the external teeth having an external diameter sized to allow entry into and positioning in the bore of the packer upon application of a downward force on the grapple body to grip and support the packer for catching the packer to prevent the packer from falling while milling the packer.

9. The packer retriever of claim 8, wherein a milling tool can be mounted with the mandrel for rotation and downward movement the grapple body moving downwardly together with the milling tool for milling the packer while the grapple body remains engaged with the packer to prevent the packer from falling during milling.

10. The packer retriever of claim 8, further comprising:

a nut on the mandrel below the grapple body; and the nut adapted to engage the grapple body upon upward movement and rotation of the mandrel for effecting a release of the external teeth of the grapple body from the bore of the packer.

11. The packer retriever of claim 8, wherein the grapple body has an external diameter slightly larger than the internal diameter of the bore of the packer when the grapple body is positioned external to the packer, but compressible upon a downward force being applied to the grapple body for effecting downward movement and gripping engagement of the external teeth with the packer bore.

12. A method of retrieving a packer having a packer bore from a wellbore using a packer retriever having a milling tool, a mandrel with a shoulder, and a grapple body, the method comprising:

lowering the packer retriever into a wellbore having a packer held therein;

engaging the packer bore with the grapple body;

milling the packer while the grapple body engages the packer bore without rotation; and retrieving the packer retriever with remaining packer components after the packer becomes free of the wellbore.

13. The method of claim 12, further comprising releasing the packer retriever from the packer bore separately from the packer.

14. The method of claim 12, further comprising alternatively engaging an extension of the packer with the grapple body.

15. The method of claim 12, further comprising alternatively engaging an object downhole for milling the object until a remainder of the object is released.

16. The method of claim 12, farther comprising alternatively applying a torque from the mandrel to the grapple body for releasing the packer retriever from the packer.

17. The method of claim 16, wherein the grapple body comprises a plurality of wickers and a key, and wherein the releasing comprises transferring torque to a portion of the grapple body and unscrewing the plurality of wickers from the packer bore.

18. The method of claim 17, wherein the releasing is aided by locating the key in the grapple body for reducing the torque required for releasing the grapple.

19. The method of claim 12, wherein the engaging comprises remaining engaged for preventing the packer from falling in the wellbore if the packer breaks free of the well bore while milling.

20. The method of claim 12, further comprising engaging the packer bore with the grapple body and releasing the grapple body from the packer bore multiple times.

21. The method of claim 12, wherein milling the packer comprises milling the packer along a circumference of the packer.

22. The method of claim 12, further comprising rotating a portion of the mandrel on a bearing of the grapple body while the grapple body remains stationary during the milling.

23. The method of claim 12, further comprising pulling up on the packer retriever for further engaging the grapple body to the packer bore.

24. The method of claim 12, wherein the grapple body comprises wickers, further comprising alternatively releasing the packer retriever from the bore of the packer before the packer is free of the wellbore, the releasing comprising unscrewing the wickers from the packer bore by right-handed rotation of the packer retriever.

* * * * *